US005275745A

United States Patent [19]

Habeeb et al.

[11] Patent Number: 5,275,745

[45] Date of Patent: Jan. 4, 1994

[54] LUBRICANT COMPOSITION CONTAINING ALKOXYLATED AMINE SALT OF TRITHIOCYANURIC ACID

[75] Inventors: Jacob J. Habeeb; Morton Beltzer, both of Westfield, N.J.

[73] Assignee: Exxon Research & Engineering Co., Florham Park, N.J.

[21] Appl. No.: 21,505

[22] Filed: Feb. 22, 1993

[51] Int. Cl.[5] ..... C10M 133/42

[52] U.S. Cl. ..... 252/33.6; 252/47.005

[58] Field of Search ..... 252/33.6, 47.5, 47.0

[56] References Cited

U.S. PATENT DOCUMENTS

| | | | |
|---|---|---|---|
| 3,156,689 | 11/1964 | Dexter et al. | 260/248 |
| 3,198,797 | 8/1965 | Dexter et al. | 260/249.5 |
| 3,202,681 | 8/1965 | Dexter et al. | 260/249.5 |
| 3,255,191 | 6/1966 | Dexter et al. | 260/248 |
| 3,334,046 | 8/1967 | Dexter et al. | 252/47.5 |
| 3,723,428 | 3/1973 | Song | 260/248 CS |
| 3,849,319 | 11/1974 | Nebzydoski | 252/33.6 |
| 3,862,942 | 1/1975 | Gilles | 260/248 CS |
| 3,951,973 | 4/1976 | Nebzydoski | 260/248 CS |
| 4,038,197 | 7/1977 | Caspari | 252/46.7 |
| 4,281,123 | 7/1981 | Hentschel et al. | 544/194 |
| 4,931,196 | 6/1990 | Payne et al. | 252/47.5 |

FOREIGN PATENT DOCUMENTS 977589 12/1964 United Kingdom .

*Primary Examiner*—Jacqueline V. Howard
*Assistant Examiner*—Cephia D. Toomer
*Attorney, Agent, or Firm*—James H. Takemoto

[57] ABSTRACT

A lubricant oil composition useful for reducing friction in an internal combustion engine which comprises (a) a major amount of a lubricant oil basestock, and (b) a minor amount of an alkoxylated amine salt of trithiocyanuric acid, said salt having the formula:

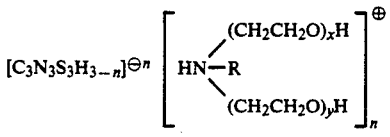

where R is a hydrocarbyl group having from 2 to 22 carbon atoms, n is an integer from 1 to 3, and x and y are each independently integers of from 1 to 15 with the proviso that the sum of x+y is from 2 to 20.

5 Claims, No Drawings

LUBRICANT COMPOSITION CONTAINING ALKOXYLATED AMINE SALT OF TRITHIOCYANURIC ACID

BACKGROUND OF THE INVENTION

1. Field of the Invention

This invention relates to a lubricant composition containing an alkoxylated amine salt of trithiocyanuric acid and its use to reduce friction and improve fuel economy in an internal combustion engine.

2. Description of the Related Art

There are many instances, as is well known, particularly under "Boundary Lubrication" conditions where two rubbing surfaces must be lubricated, or otherwise protected, so as to prevent wear and to insure continued movement. Moreover, where, as in most cases, friction between the two surfaces will increase the power required to effect movement and where the movement is an integral part of an energy conversion system, it is most desirable to effect the lubrication in a manner which will minimize this friction. As is also well known, both wear and friction can be reduced, with various degrees of success, through the addition of a suitable additive or combination thereof, to a natural or synthetic lubricant. Similarly, continued movement can be insured, again with varying degrees of success, through the addition of one or more appropriate additives.

The primary oil additive for the past 40 years for providing antiwear and antioxidant properties has been zinc dialkyldithiophosphate (ZDDP). Oil formulations containing ZDDP, however, require friction modifiers in order to reduce energy losses in overcoming friction. Such energy losses result in lower fuel economy. Moreover, oil additive packages containing ZDDP have environmental drawbacks. ZDDP adds to engine deposits which can lead to increased oil consumption and emissions. Moreover, ZDDP is not ash-free. Various ashless oil additive packages have been developed recently due to such environmental concerns.

U.S. Pat. Nos. 3,849,319 and 3,951,973 describe lubricant compositions containing di- and tri(hydrocarbylammonium)trithiocyanurates. The hydrocarbyl radicals include alkyl, aralkyl, aryl, alkaryl and cycloalkyl and the examples are directed to alkylamines. These lubricant compositions were stated to have improved loadcarrying properties.

It would be desirable to have a lubricating oil composition which provides excellent friction reducing, fuel economy properties and environmentally beneficial (less fuel, i.e., less exhaust emission) properties.

SUMMARY OF THE INVENTION

This invention relates to lubricant compositions containing alkoxylated amine salts of trithiocyanuric acid having improved friction reducing properties which results in improved fuel economy in an internal combustion engine. The lubricating oil composition comprises (a) a major amount of a lubricating oil basestock and (b) a minor amount of an alkoxylated amine salt of trithiocyanuric acid, said amine salt having the formula $$[C_3N_3S_3H_{3-n}]^{\ominus n}\left[HN\begin{matrix}-(CH_2CH_2O)_xH\\-(CH_2CH_2O)_yH\end{matrix}\right]^{\oplus}_{n} \quad (I)$$

where R is a hydrocarbyl group having from 2 to 22 carbon atoms, n is an integer from 1 to 3, and x and y are each independently integers of from 1 to 15 with the proviso that the sum of x+y is from 2 to 20. In another embodiment, there is provided a method for reducing friction in an internal combustion engine which comprises operating the engine with a lubricating oil containing an amount effective to reduce friction of an alkoxylated amine salt of trithiocyanuric acid having the formula (I) set forth above.

DETAILED DESCRIPTION OF THE INVENTION

In the lubricating oil composition of the present invention, the lubricating oil will contain a major amount of a lubricating oil basestock. The lubricating oil basestock are well known in the art and can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal and shale.

Synthetic oils include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogs, and homologs thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers.

Silicon-based oils (such as the polyakyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

The amine salts of trithiocyanuric acid are prepared from the reaction of alkoxylated, preferably propoxylated or ethoxylated, especially ethoxylated amines with trithiocyanuric acid. Preferred ethoxylated amines used to prepare amine salts have the formula

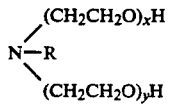

where R is a hydrocarbyl group of from 2 to 22 carbon atoms, preferably 6 to 18 carbon atoms. The hydrocarbyl groups include aliphatic (alkyl or alkenyl) groups which may be substituted with hydroxy, mercapto or amino and the hydrocarbyl group may also be interrupted by oxygen, nitrogen or sulfur. The sum of x+y is preferably 2 to 15. Ethoxylated and/or propoxyltes amines are commercially available from Sherex Chemicals under the trade name Varonic and from Akzo Corporation under the trade names Ethomeen ®, Ethoduomeen ®, and Propomeen ®. Examples of preferred amines containing from 2 to 15 ethoxy groups include ethoxylated (5) cocoalkylamine, ethoxylated (2) tallowalkylamine, ethoxylated (15) cocoalkylamine and ethoxylated (5) soyaalkylamine.

Trithiocyanuric acid may exist in different tautomeric forms represented by formulas II, III or mixtures thereof:

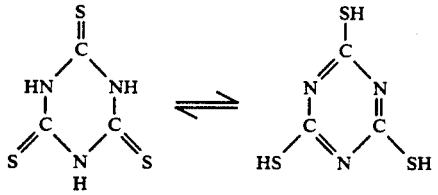

II III

Trithiocyanuric acid is prepared by methods well known in the art. These methods involve the treatment of cyanuric chloride with sulfur nucleophiles according to the following reaction schemes:

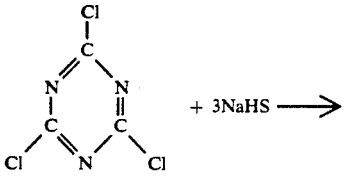

-continued

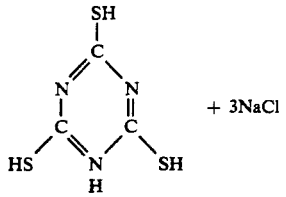

Other sulfur nucleophiles which may be employed in the above reaction scheme include sodium sulfide, thiourea and thioacetic acid.

The alkoxylated amine salts according to the invention are prepared by methods known to those skilled in the art. The preparative reaction scheme is illustrated as follows:

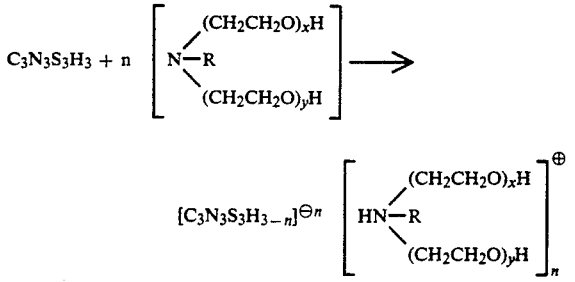

where R, x and y are defined as above and ft-is an integer from 1 to 3, preferably 3.

The lubricant oil composition according to the invention comprises a major amount of lubricating oil basestock and an amount effective to increase fuel economy of the alkoxylated amine salt. Typically, the amount of amine salt will be from about 0.001 wt% to about 5 wt%, based on oil basestock. Preferably, the amount of amine salt is from about 0.05 wt% to about 1.0 wt%.

If desired, other additives known in the art may be added to the lubricating oil basestock. Such additives include dispersants, antiwear agents, antioxidants, rust inhibitors, corrosion inhibitors, detergents, pour point depressants, extreme pressure additives, viscosity index improvers, other friction modifiers, hydrolytic stabilizers and the like. These additives are typically disclosed, for example, in "Lubricant Additives" by C. V. Smalhear and R. Kennedy Smith, 1967, pp. 1-11 and in U.S. Pat. No. 4,105,571, the disclosures of which are incorporated herein by reference.

The lubricating oil composition of this invention can be used in the lubrication system of essentially any internal combustion engine, including automobile and truck engines, two-cycle engines, aviation piston engines, marine and railroad engines, and the like. Also contemplated are lubricating oils for gas-fired engines, alcohol (e.g., methanol) powered engines, stationary powered engines, turbines, and the like.

This invention may be further understood by reference to the following example, which includes a preferred embodiment of this invention.

EXAMPLE 1

This Example illustrates the preparation of an ethoxylated amine salt of trithiocyanuric acid according to the invention. 100 g of ethoxylated(5)cocoalkylamine was heated to 70° C. with stirring in a 3-neck round bottom flask fitted with a thermometer and a water cooled condenser. 14 g of trithiocyanuric acid was added gradually to the stirred amine solution. During addition, the temperature rose to 105° C. due to the exothermic reaction between acid and amine. The reaction mixture was maintained at 105° C. for 2 hours and then cooled to room temperature. The reaction mixture was that of a salt of the formula:

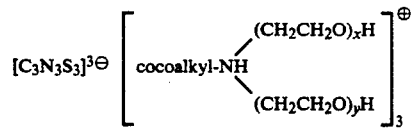

where x+y=5 and was used without further purification.

Example 2

The ethoxylated amine salt of trithiocyanuric acid is an effective friction modifier as shown in this example. The Ball on Cylinder (BOC) friction tests were performed using the experimental procedure described by S. Jahanmir and M. Beltzer in ASLE Transactions, Vol. 29, No. 3, p. 425 (1985) using a force of 0.8 Newtons (1 Kg) applied to a 12.5 mm steel ball in contact with a rotating steel cylinder that has a 43.9 mm diameter. The cylinder rotates inside a cup containing a sufficient quantity of lubricating oil to cover 2 mm of the bottom of the cylinder. The cylinder was rotated at 0.25 RPM. The friction force was continuously monitored by means of a load transducer. In the tests conducted, friction coefficients attained steady state values after 7 to 10 turns of the cylinder. Friction experiments were conducted with an oil temperature of 100° C. Various amounts of ethoxylated(5)cocoalkyl amine trithiocyanurate prepared in Example 1 were added to solvent 150 N. The results of BOC friction tests are shown in Table 1.

TABLE 1

| Wt % of Ethoxylated(5)Cocoalkylamine Trithiocyanurate in Solvent 150N* | Coefficient Of Friction |
|---|---|
| 0.00 | 0.29 |
| 0.05 | 0.16 |
| 0.10 | 0.076 |
| 0.20 | 0.06 |
| 0.30 | 0.05 |

TABLE 1-continued

| Wt % of Ethoxylated(5)Cocoalkylamine Trithiocyanurate in Solvent 150N* | Coefficient Of Friction |
|---|---|
| 0.50 | 0.05 |
| 0.80 | 0.05 |
| 1.00 | 0.05 |

*S150 is a solvent extracted, dewaxed, hydrofined neutral lube base stock obtained from approved paraffinic crudes (viscosity, 32 cSt at 40° C., 150 Saybolt seconds).

As can be seen from the results in Table 1, as little as 0.05 wt. % of ethoxylated amine salt shows an 45% decrease in the coefficient of friction. At 0.2 wt. % amine salt, the coefficient is reduced by 79%. These results demonstrate that the ethoxylated amine salts of trithiocyanuric acid are capable of significant reductions in the coefficient of friction of a lubricant basestock which results in less friction and hence greater fuel economy when the lubricated oil is used in an internal combustion engine.

What is claimed is:

1. A lubricant oil composition which comprises:

(a) a major amount of a lubricant oil basestock, and (b) a minor amount of an alkoxylated amine salt of trithiocyanuric acid, said salt having the formula:

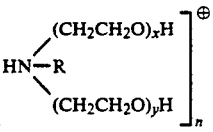

where R is a hydrocarbyl group having from 2 to 22 carbon atoms, n is an integer from 1 to 3, and x and y are each independently integers of from 1 to 15 with the proviso that the sum of x+y is from 2 to 20.

2. The composition of claim 1 wherein R is alkyl or alkenyl of 6 to 18 carbon atoms.

3. The composition of claim 1 wherein the sum of x+y is from 2 to 15.

4. The composition of claim 1 wherein the amount of amine salt is from about 0.001 to about 5 wt. %, based on oil.

5. A method for reducing friction in an internal combustion engine which comprising operating an internal combustion engine with a lubricating oil composition containing an amount effective to reduce friction of the ethoxylated amine salt of trithiocyanuric acid of claim 1.

* * * * *